US011484881B2

(12) United States Patent
Chueh et al.

(10) Patent No.: US 11,484,881 B2
(45) Date of Patent: Nov. 1, 2022

(54) BIOMOLECULE DIAGNOSTIC SYSTEMS

(71) Applicant: AXBIO INC., Santa Clara, CA (US)

(72) Inventors: Albert Chueh, Santa Clara, CA (US); Stephen F. Dreyer, Santa Clara, CA (US); Priyanka Agrawal, Santa Clara, CA (US); Igor Ivanov, Santa Clara, CA (US); Hui Tian, Santa Clara, CA (US)

(73) Assignee: AXBIO INC., Santa Clara, CA (US)

( * ) Notice: Subject to any disclaimer, the term of this patent is extended or adjusted under 35 U.S.C. 154(b) by 153 days.

(21) Appl. No.: 16/911,613

(22) Filed: Jun. 25, 2020

(65) Prior Publication Data

US 2020/0406259 A1 Dec. 31, 2020

Related U.S. Application Data

(60) Provisional application No. 62/867,681, filed on Jun. 27, 2019.

(51) Int. Cl.
*B01L 3/00* (2006.01)

(52) U.S. Cl.
CPC ... *B01L 3/502738* (2013.01); *B01L 2200/025* (2013.01); *B01L 2200/026* (2013.01); *B01L 2300/0645* (2013.01); *B01L 2400/0633* (2013.01)

(58) Field of Classification Search
CPC ..... B01L 3/502738; B01L 3/715; B01L 2200/025; B01L 2200/026; B01L 2200/027; B01L 2200/147; B01L 2300/0645; B01L 2300/0816; B01L 2300/0867; B01L 2400/0633; B01L 2400/0487; B01L 2400/0638; B01L 2400/049; B01L 9/52
See application file for complete search history.

(56) References Cited

U.S. PATENT DOCUMENTS

| | | | | |
|---|---|---|---|---|
| 5,955,028 | A | 9/1999 | Chow | |
| 2005/0003554 | A1 | 1/2005 | Brasseur | |
| 2005/0243304 | A1 | 11/2005 | Padmanabhan et al. | |
| 2012/0040468 | A1* | 2/2012 | Khaled | B01L 3/502715 436/95 |
| 2012/0195794 | A1* | 8/2012 | Lebl | F04B 19/006 422/63 |
| 2018/0015474 | A1* | 1/2018 | Arlett | B01L 3/527 |

FOREIGN PATENT DOCUMENTS

WO 2017/091618 A1 6/2017

OTHER PUBLICATIONS

International Search Report and Written Opinion for Application No. PCT/US2020/039499, dated Dec. 9, 2020, 17 pages.
Partial Search for International Application No. PCT/US2020/039499, dated Oct. 14, 2020, 12 pages.
International Preliminary Report on Patentability for Application No. PCT/US2020/039499, dated Jan. 6, 2022, 10 pages.

* cited by examiner

*Primary Examiner* — Jennifer Wecker
*Assistant Examiner* — Alea N. Martin

(57) ABSTRACT

Diagnostic systems for sensing biological molecules are disclosed. The diagnostic systems include a fluid control delivery and control system that can be coupled to a diagnostic cartridge that includes a microfluidic device and integrated sensing electronics. The diagnostic systems can be used to sequence biological molecules.

15 Claims, 6 Drawing Sheets

BIOMOLECULE DIAGNOSTIC SYSTEMS

This application claims the benefit under 35 U.S.C. § 119(e) of U.S. Provisional Application No. 62/867,681, filed on Jun. 27, 2019, which is incorporated by reference in its entirety.

FIELD

The present disclosure relates to diagnostic systems for sensing biological molecules. The diagnostic systems include a fluid control delivery and control system that can be coupled to a diagnostic cartridge that includes a microfluidic device with integrated sensing electronics. The diagnostic systems can be used to sequence biological molecules.

BACKGROUND

Accurate biosequencing can be an expensive and time-consuming process. Improved apparatus that provide accurate and cost-effective sequence information within a reasonable time are desired.

SUMMARY

According to the present invention, diagnostic systems comprise an interconnection substrate; a diagnostic cartridge socket electrically connected to the interconnection substrate; and a fluid management apparatus mounted on a translation stage, wherein the translation stage is configured to fluidly couple the fluid management apparatus to a diagnostic cartridge mounted in the diagnostic cartridge socket.

According to the present invention diagnostic cartridges comprise a cartridge interconnection substrate; a biosensing device interconnected to the cartridge interconnection substrate; and a microfluidics component bonded to the cartridge interconnection substrate and fluidly coupled to the biosensing device.

BRIEF DESCRIPTION OF THE DRAWINGS

Those skilled in the art will understand that the drawings described herein are for illustration purposes only. The drawings are not intended to limit the scope of the present disclosure.

DETAILED DESCRIPTION

Figure 1A:
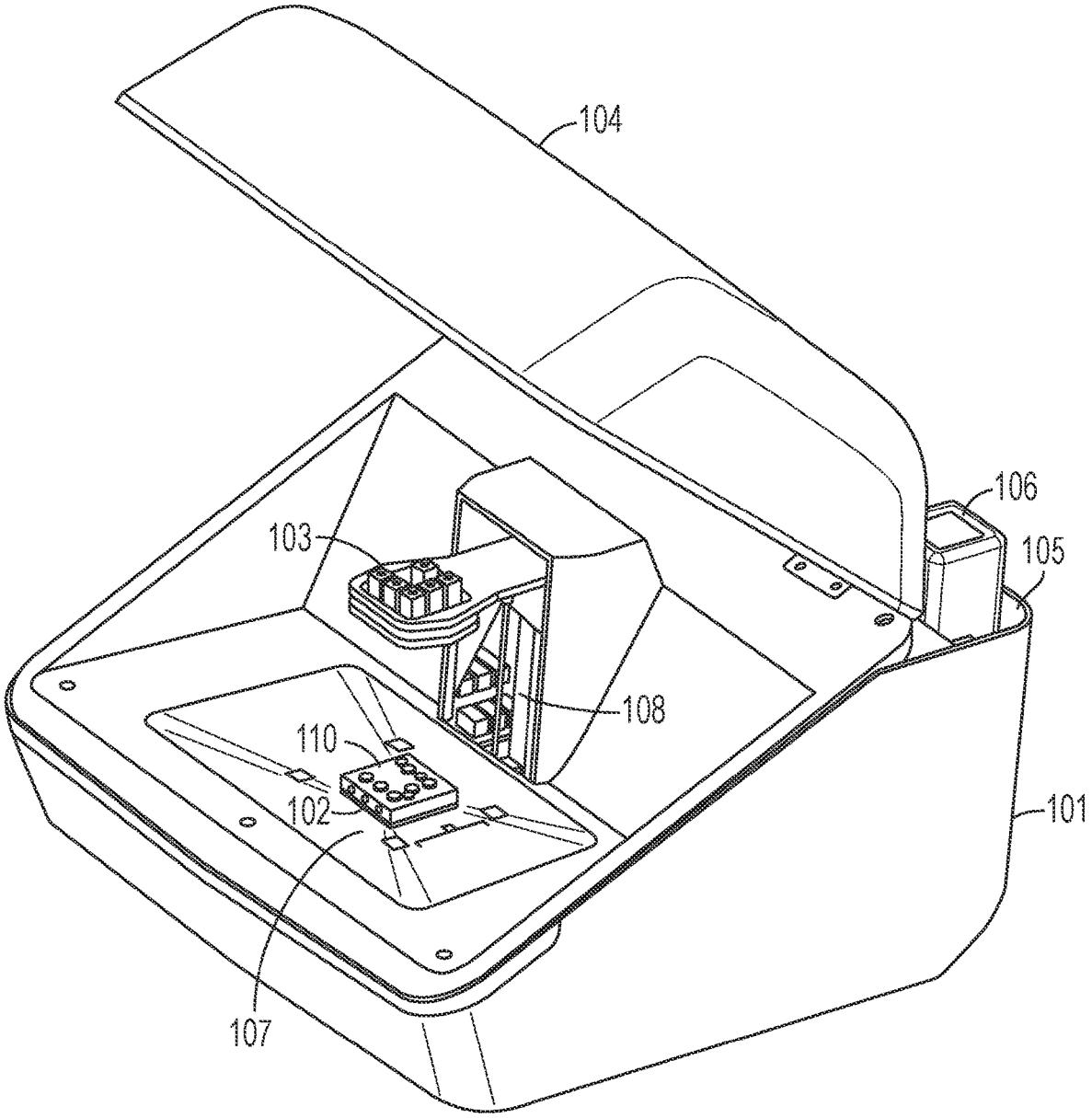
FIGS. 1A and 1B show perspective views of an example of a diagnostic system according to the present disclosure.

For purposes of the following description, it is to be understood that embodiments provided by the present disclosure may assume various alternative variations and step sequences, except where expressly specified to the contrary. Moreover, other than in the examples, or where otherwise indicated, all numbers expressing, for example, quantities of ingredients used in the specification and claims are to be understood as being modified in all instances by the term "about." Accordingly, unless indicated to the contrary, the numerical parameters set forth in the following specification and attached claims are approximations that may vary depending upon the desired properties to be obtained. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges encompassed therein. For example, a range of "1 to 10" is intended to include all sub-ranges between (and including) the recited minimum value of about 1 and the recited maximum value of about 10, that is, having a minimum value equal to or greater than about 1 and a maximum value of equal to or less than about 10. Also, in this application, the use of "or" means "and/or" unless specifically stated otherwise, even though "and/or" may be explicitly used in certain instances.

Diagnostic systems provided by the present disclosure can be used to sense biological molecules. The diagnostic systems include electronics, a socket for electrically interconnecting a diagnostic cartridge, a reagent delivery and reagent control system, and other components. The components can be retained within a housing. The diagnostic systems can be used with a diagnostic cartridge having integrated electronics and microfluidic components and can be provided with simple fluid interfaces and valves for controlling the flow of reagents through the microfluidic component and a biosensing device.

Diagnostic systems provided by the present disclosure provide the ability to sequence biological samples on a massively parallel scale thereby facilitating the ability to provide accurate and reproducible results in a timely manner. The diagnostic cartridge used to sense biological molecules integrates the sensing electronics and microfluidics in a simple physical format and is intended to be disposable. The diagnostic system provides a simple electronic socket interface to control and processing electronics and that can easily be coupled to reagents and flow control components.

Figure 1B:
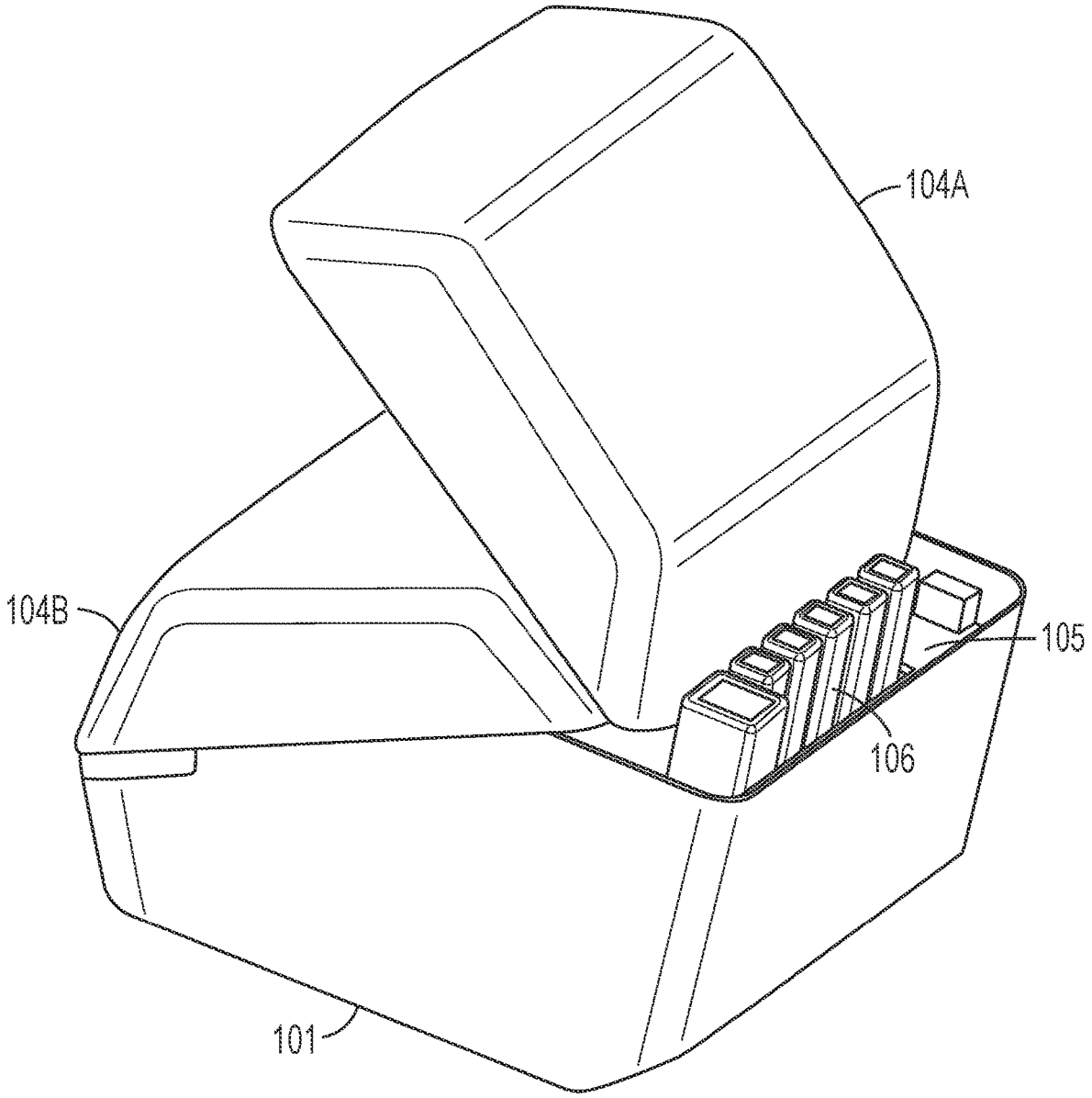

Solid views of an example of a diagnostic system provided by the present disclosure are shown in FIGS. 1A and 1B. The dimensions of the system can be, for example, less than $12\times12\times12$ in$^3$ ($31\times31\times31$ cm$^3$). As shown in FIG. 1A, the diagnostic system includes a housing 101, a cartridge interface 102, shown with an interconnected diagnostic cartridge 110, a fluid management apparatus 103 including fluid delivery and control interface unit 109, a hinged cover 104, and a shelf 105 for holding multiple reagent containers 106. The housing 101 retains, for example, electronics, thermal control elements, a cartridge socket, a fluid management assembly, I/O interfaces, and other elements, which can be mounted on an interconnection substrate.

The base 107 includes a receptacle for retaining and interconnecting a diagnostic cartridge 110 to an interconnection substrate (not shown) retained within the base 107. A vertical translation stage 108 is mounted toward the back of the diagnostic system and is used to control, in this example, the vertical position of the fluid delivery and control interface unit 109. The translation stage 108 is configured to couple the fluid delivery and control interface unit 109 to the diagnostic cartridge 110. Reagent containers 106 and waste containers (not shown) can be mounted in receptacles located toward the back of the diagnostic system and can be fluidly coupled to the fluid management apparatus 103.

FIG. 1B shows a rear view of the diagnostic system highlighting the shelf 105 with multiple reagent containers 106 and with the cover in the open 104A and closed 104B configurations The housing can be made from any suitable material such as a metal, thermoplastic, thermoset, or composite. The hinged cover provides easy access to the diagnostic cartridge socket for inserting and removing a diagnostic cartridge from the socket. The location of the reagent containers external to the covered area facilitates the ability of a user to replace the containers as necessary during operation of the diagnostic system and/or between use of diagnostic cartridges.

Figure 5:
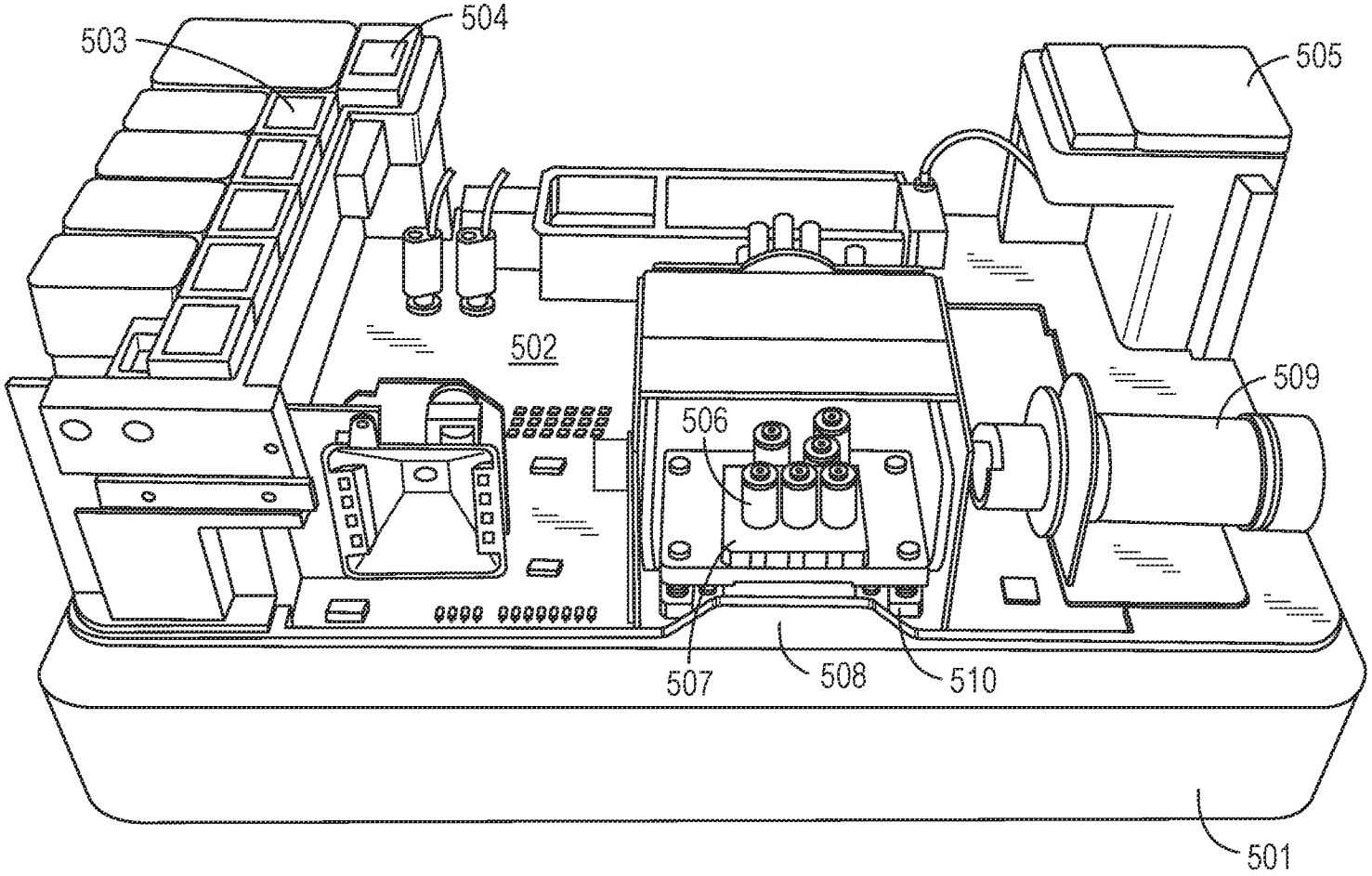
FIG. 5 shows a perspective view of another example of a diagnostic system according to the present disclosure.

Another example of a diagnostic system provided by the present disclosure is shown in FIG. 5. The diagnostic system shown in FIG. 5 includes a base 501, a system interconnection substrate 502 which is mounted various control and signal processing electronics, and agnostic cartridge socket 510 mounted on an electrically interconnected to the system interconnection substrate 502. Fluid management apparatus 507 is shown fluidly coupled to the diagnostic cartridge (hidden), which includes actuators 506 which are fluidly coupled through tubing (not shown) and to reagents 503 and 504 and to waste reservoir 505. Translator 509 is configured to engage and disengage the fluid management system with the diagnostic cartridge.

Highly integrated sequencing devices can be provided in the form of a disposable diagnostic cartridge that combines a microfluidics component and a biosensing device in a single, integrated package having an area, for example, less than 10 $mm^2$. The microfluidics component provides an interface between external fluid sources such as reagents and test samples and the biosensing device. The biosensing device is electrically interconnected to control and measurement circuitry integrated into the diagnostic cartridge. As an integrated package, the cartridge provides separable fluidics and electronics interfaces.

Figure 2:
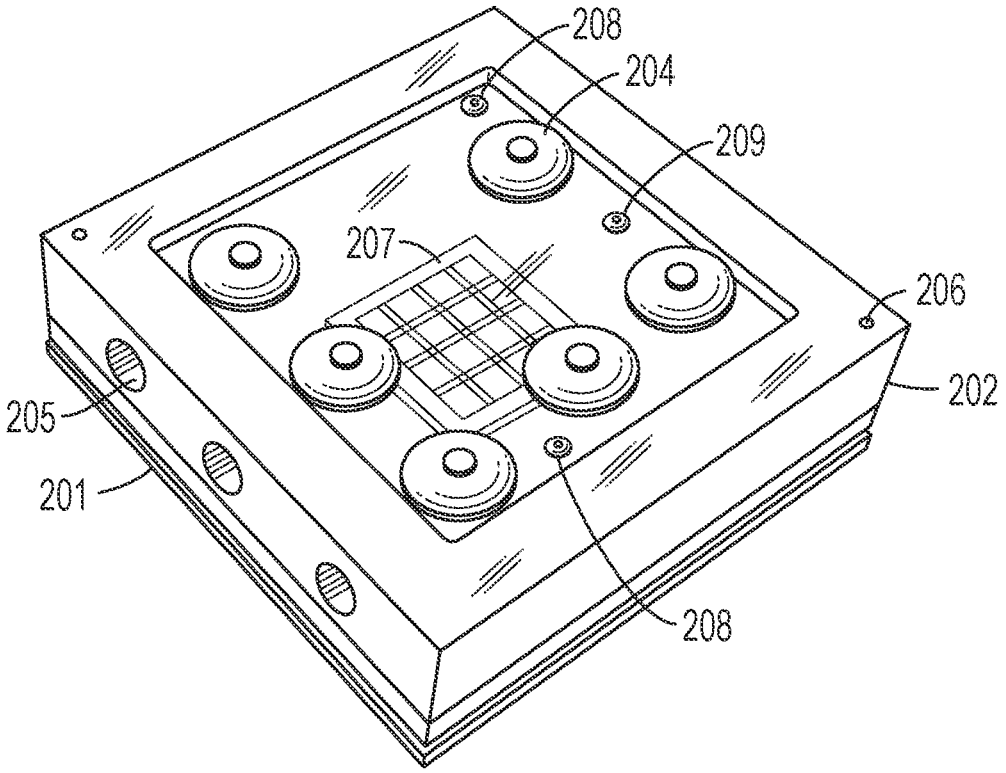
FIG. 2 shows a perspective view of an example of a diagnostic cartridge according to the present disclosure.

A view of an example of a diagnostic cartridge provided by the present disclosure is shown in FIG. 2. The diagnostic cartridge includes biosensing electronics mounted on an interconnection substrate 201. A microfluidic component 202 is secured to the interconnection substrate by means of an adhesive. The microfluidics component 202 includes multiple microfluidics layers including, for example, sample reservoirs, fluid routing channels and biosensing cells. A biosensing device 203 is fluidly coupled to microfluidic component 202 and electrically interconnected to the biosensing device interconnection substrate 201. Flow of reagent and test samples within the microfluidic component 202 and the biosensing device 203 can be controlled by microvalves 204 accessible on the exterior surface of the microfluidic component 202. Microfluidic component 202 can also include inlet ports 208 and an outlet port 209. The diagnostic cartridge shown in FIG. 2 includes six (6) microvalves 204. For example, three (3) microvalves can be used to control the introduction of test sample into the microfluidic component 202 and biosensing device 203, one (1) microvalve can be used to control the introduction of reagents into the microfluidic component 202 and biosensing device 203, and two (2) microvalves can be used to control the flow of test sample and/or reagents within and from the microfluidic component 202 and the biosensing device 203. The microvalves can be normally closed and/or normally open. Suitable microvalves include, for example, membrane-type microvalves and plug-type microvalves that can be controlled by a force applied by an external element such as a solenoid.

The diagnostic cartridge shown in FIG. 2 also includes three (3) side ports 205 that can be used to introduce test sample into respective sample reservoirs within the microfluidic component 202. The diagnostic cartridge shown in FIG. 2 also includes holes 206 for alignment pins for aligning the diagnostic cartridge to a pad grid array on the underside of the electronics interface with a cartridge socket.

A biosensing device interconnection substrate can be any suitable material such as, for example, a printed circuit board material. A biosensing device interconnection substrate provides an electrical interface between the biosensing device and external electronics. An array of contact pads on the underside of a biosensing device interconnection substrate is configured to separably interconnect the biosensing device with respective connectors of a diagnostic cartridge socket.

A biosensing device can be mounted on and interconnected to the electronic interface and can be fluidly coupled to the microfluidics component at a biosensing device inlet and a biosensing device outlet. The biosensing device includes an array, for example, of from 1,000 to 10,000,000 biosensing cells. Electrodes within each of the biosensing cells are independently accessible through integrated electronics such as CMOS circuitry integrated into the biosensing device interconnection substrate. Biosensing cells include printed a working electrode. The microfluidic component includes a printed counter electrode that is electrically coupled to the working electrodes through fluid within the biosensing device. Each of the biosensing cells is fluidly coupled to the biosensing device inlet and the biosensing device outlet. A biosensing device may or may not incorporate microfluidic control mechanisms.

A microfluidic component can comprise multiple fluidic layers and can include channels, integrated channel valves, and sample reservoirs. The integrated valves can be electrically connected to control circuitry on a system interconnection substrate. The microfluidic layers can be made from any suitable material such as, for example, polycarbonate, poly(methyl) methacrylate, cyclic olefin copolymer, polyimide, or silicone. The microfluidic layers can be fabricated using any suitable process such as by injection molding. The microfluidic layers, biosensing device, and cartridge interconnection substrate can be assembled into an integrated assembly using suitable adhesives.

Diagnostic cartridges provided by the present disclosure can be disposable after a single use. The high level of integration, design simplicity, and use of low-cost materials provides for a cost-effective biosensing solution.

A diagnostic system can include, for example, two levels of temperature control A first level of temperature control can include a temperature sensor coupled to a cooling apparatus such as a fan through a control circuit such as a proportion integrated derivative (PID) circuit. The system level temperature control maintains the internal temperature of the system within a range, for example, from 20° C. to 30° C., when the cover is closed, and the system is operating. A diagnostic system can also include a diagnostic cartridge level temperature control. One or more temperature sensors situated in the vicinity of the biosensing device can be coupled to a temperature controller such as a Peltier device thermally coupled to the diagnostic cartridge in the vicinity of the biosensing device. Diagnostic cartridge level temperature control can be configured to maintain a constant temperature during operation within a range, for example, from 10° C. to 35° C. The temperature can be maintained, for example, within 1° C., within 2° C., within 3° C., within 4° C., or within 5° C. within the range during a biosequencing operation. Diagnostic cartridge level temperature control can be used to change the temperature during operation such as to perform polymerase chain reactions (PCR). During typical PCR cycles of denaturation, annealing and extension are repeated to amplify a target sequence. Temperatures doting each phase can range, for example, from 94 to 98, from 48 to 72, and from 68 to 72. Each step can take from 0.5 min to 3 min and the PCR cycle repeated from 25 to 35 times.

Figure 3:
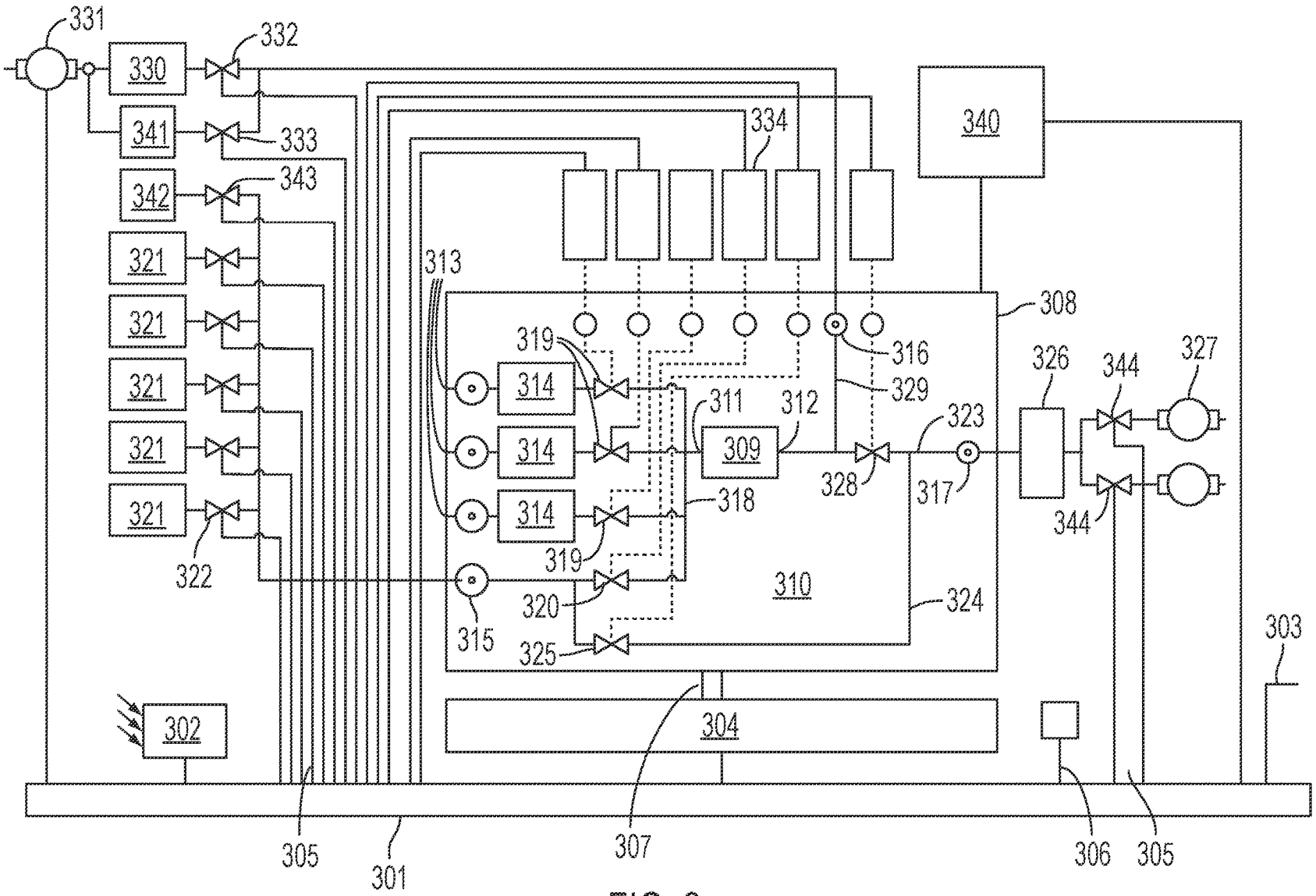
FIG. 3 shows a schematic diagram of an example of a fluid control system according to the present disclosure.

A schematic of an example of a diagnostic system and in particular the microfluidics of a diagnostic system provided by the present disclosure is shown in FIG. 3. The diagnostic system shown in FIG. 3 includes a system interconnection substrate 301. Electronics circuitry including buffers, amplifiers, FIFO, microcontroller (not shown), temperature sensors 302, I/O interfaces 303, a diagnostic cartridge socket 304, microfluidics control circuitry 305, system temperature control circuitry 306, diagnostic cartridge temperature control circuitry (not shown), and robotic position control circuitry 340, are mounted to the interconnection substrate 301. The diagnostic cartridge socket 304 includes electrical interconnects 307 for interconnecting to the cartridge interconnection substrate (not shown) of the diagnostic cartridge 308. The electrical interconnects 307 can comprise, for example, an array of spring-loaded micro-connectors.

Robotic positioning system 340 can include a sensing element such as an optical system for aligning the diagnostic cartridge 308 with respect to the diagnostic cartridge socket 304 and/or to the fluid management apparatus (not shown) with respect to the diagnostic cartridge 308.

Diagnostic cartridge 308 includes a biosensing device 309, which, for example, can include an array of from 1,000 to 10,000,000 biosensing cells. Diagnostic cartridge 308 also includes a microfluidic component 310. Microfluidic component 310 includes fluid channels, sample reservoirs, microvalves, inlets, and an outlet. Microfluidic component 310 is fluidly coupled to biosensing device 309 through biosensing device inlet 311 and biosensing device outlet 312.

Microfluidic component 310 includes one or more sample injection ports 313 for injecting test samples, which can be retained in respective sample reservoirs 314.

Microfluidic component 310 further includes first cartridge inlet 315, second cartridge inlet 316, and cartridge outlet 317.

Biosensing device inlet 311 is fluidly coupled to inlet channel 318. Inlet channel 318 is fluidly coupled to sample reservoirs 314 through sample control valves 319. Sample control microvalves 319 can be activated external to the diagnostic cartridge. Sample control microvalves 319 can be mechanically activated microvalves, such as solenoid-activated microvalves. Referring to FIG. 2, examples of solenoid-activated microvalves 204 are shown on the upper exterior surface of the microfluidic component 202 of the diagnostic cartridge.

Inlet channel 318 is also fluidly coupled to first cartridge inlet 315 through first cartridge inlet control valve 320.

First cartridge inlet port 315 can be fluidly coupled to one or more reagent sources 321. Each of the one or more reagent sources 321 is controllably fluidly coupled to first cartridge inlet port 315 through respective reagent control valves 322. Reagent sources 321 can be coupled to inlet port 315 using suitable small-diameter tubing. Reagent control valves can be selectively coupled to the cartridge inlet port 315 to provide single reagents or a desired combination of reagents. Reagents can be coupled to control valves and to first cartridge inlet 315 using tubing.

First cartridge inlet port 315 is also coupled to gas source and filter 342 through valve 343. Gas source 342 can be any suitable gas such as air or argon. Gas source 342 can be used to purge the microfluidics and biosensing device.

Inlet channel 315 can also be fluidly coupled to outlet channel 323 through bypass channel 324 and bypass microvalve 325.

Biosensing device outlet 312 is fluidly coupled to cartridge outlet port 317 through biosensing device outlet channel 323 and outlet control microvalve 328. Cartridge outlet port 317 can be fluidly coupled to external waste container 326 and to one or more vacuum pumps 327 controlled by respective vacuum control valves 344. Biosensing device outlet channel 323 can also be fluidly coupled to second cartridge inlet port 316 through second inlet channel 329. Second cartridge inlet port 316 can be fluidly coupled to reagent source 330 and to pressure source 331 through control valve 332 and pressure source control valve 333. Valve 332 and valve 333 are coupled to pressure source 331 through filter 341 to provide a positive pressure at the second inlet port 316.

Microfluidic component 310 further includes reagent bypass channel 324 fluidly coupling first inlet channel 318 to outlet channel 323 through bypass control microvalve 325. Bypass channel 324 is coupled to the inlet channel 318 between first cartridge inlet port 315 and first inlet channel control valve 320, and to the outlet channel 323 between outlet control microvalve 328 and cartridge outlet port 317.

The one or more sample inlet ports 313 can be disposed on the top or on the side of the microfluidic component 310 of the diagnostic cartridge 308. Locating the sample inlet ports 313 on the side of the diagnostic cartridge facilitates the ability to inject sample material into the diagnostic cartridge when the diagnostic cartridge is engaged by the fluid management apparatus and interconnected to the cartridge socket.

First cartridge inlet port 315, cartridge outlet port 317, sample channel control microvalves 319, first inlet channel control microvalve 320, bypass channel control microvalve 325, and outlet channel control microvalve 328, and second cartridge inlet port 316 can be disposed on the top surface of the microfluidic component 310. This placement facilitates the ability of a fluid management apparatus to press onto the top of the diagnostic cartridge and engage with the fluid channels and the microvalves.

The fluid management apparatus can include mechanical actuators 334 for microvalves 319, 320, 325, and 328, and also fluid couplings for first cartridge inlet port 315, second cartridge inlet port 316, and cartridge outlet port 317.

Figure 4:
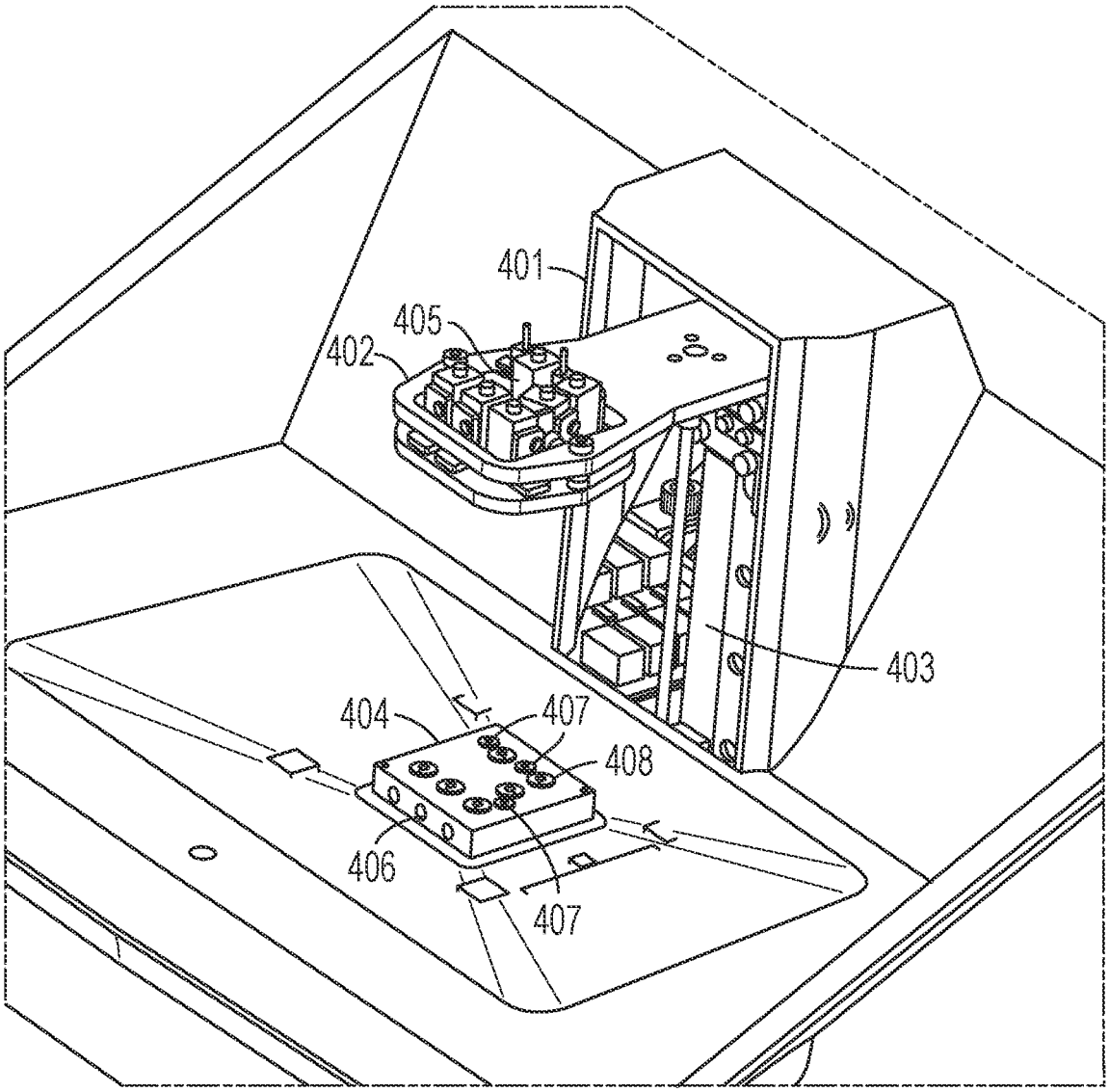
FIG. 4 shows a perspective view of an example of a fluid management apparatus mounted in vertical alignment with a disposable diagnostic cartridge according to the present disclosure.

An example of a fluid management apparatus provided by the present disclosure is shown in FIG. 4.

Fluid management apparatus 401 includes a platform 402 mounted on a translation stage 403 that lowers the platform to engage the diagnostic cartridge 404 and raises the platform 402 to disengage the components mounted on the platform 402 from a diagnostic cartridge 404.

In FIG. 4 the platform 402 is shown is being mounted above the diagnostic cartridge 404 and the translation stage 403 operates vertically. However, the diagnostic cartridge can be mounted vertically, and the translation stage can move the platform horizontally to engage with the diagnostic cartridge. Furthermore, although FIG. 4 shows a single diagnostic cartridge and a single fluid management apparatus, a diagnostic system provided by the present disclosure can include more than one diagnostic cartridge and/or more than one fluid management apparatus. For example, a diagnostic system can include more than one diagnostic cartridge and a single fluid management apparatus can move to sequentially engage each diagnostic cartridge. In this configuration, the translation stage can include the ability to translate horizontally as well as vertically. As another example, a diagnostic system can include multiple diagnostic cartridges with each diagnostic cartridge being associated with a separate fluid management apparatus.

Fluid management apparatus 401 can include actuators 405 mounted on platform 402 for controllably actuating respective microvalves 406 on diagnostic cartridge 404.

Platform 402 can include a self-leveling mount such that a lower element 409 is spring mounted on an upper rigid element. When lowered onto a diagnostic cartridge the lower element 409 engages and can tilt to provide an even pressure to the upper surface of the diagnostic cartridge.

Translation stage 403 can be controlled, for example, using a stepper motor.

Couplings to the first cartridge inlet port, the second cartridge inlet port and the cartridge outlet port can also be integrated into the platform 402 such that the ports are fluidly connected when the fluid management apparatus 401 engages the diagnostic cartridge 404.

Waste container and vacuum valves can be integrated into the fluid management system or can be external to the fluid management apparatus.

Pressure sources and vacuum sources can be external to the fluid management system and coupled to the fluid management system using appropriate elements.

Injection ports can be used to introduce, for example, biological samples, markers, and membranes.

Microvalves can include, for example, silicone plugs and membrane valves.

Reagents can include, for example, buffers, lipids, macromolecules such as nanopores and/or enzymes, nucleotides, tagged nucleotides, and combinations of any of the foregoing. Reagents can be used to form a nanopore in individual biosensing cells of the biosensing device. For example, a first reagent can comprise a buffer, a second reagent can comprise a buffer and a lipid, a third reagent can comprise an isopropyl alcohol, a fourth reagent can comprise a nanopore, and a fifth reagent can comprise distilled water. Reagents can be used, for example, to prepare the biosensing device, assemble lipid bilayers, introduce nanopores, process biological samples, adjust pH, and clean the system. As an example, the reagents can be sequentially introduced into the biosensing device through the microfluidics channels of the diagnostic cartridge.

Reagents can be purged from the channels and tubing by flowing reagent through bypass channel 324 through valve 325 to waste container 326.

Pressure can be applied to the microfluidic component using any suitable pump (see element 331 in FIG. 3). For example, the pressure source can be a peristaltic pump. A pressure source can provide a pressure, for example, from 5 psi to 10 psi.

Pressure can be applied to the microfluidic component using any suitable gas. For example, a gas can be air, nitrogen, or an inert gas such as argon. A filter can be disposed between the pressure source and the gas control valve to prevent gases, oils, and other contaminates from entering the gas control valve and diagnostic cartridge.

A vacuum pump can comprise any suitable vacuum pump such as, for example, a peristaltic pump. FIG. 3 shows two vacuum pumps, although a single pump can be used. It is desirable that a wide range of flow rates be used such as from 0.01 μL/sec to 500 μL/sec, which may be provided by using one or more pumps. To provide for fine control of the flow rate multiple pumps can be used with each pump capable of controlling fluid flow over a portion of the range.

The pressure sources and the vacuum sources can be selectively controlled so that a push/pull action can be applied to the microfluidics channel and to the biosensing device. For example, referring to FIG. 3, outlet valve 328 and pressure control valve 333 can be alternately opened and closed while other valves are closed to generate positive and negative pressures within the biosensing device and biosensing cells to thereby agitate the fluid within the biosensing cells. This reciprocal motion can disrupt laminar flow and boundary layers.

Reagents may be driven to the diagnostic cartridge by a variety of methods including, for example, application of pressure, application of vacuum, and or by gravity feed. The reagent or combination of reagents entering the diagnostic cartridge can be selectively controlled.

Sequences of polynucleotides contained in a biological sample can be analyzed using the diagnostic system provided by the present disclosure.

Diagnostic cartridges provided by the present disclosure are intended to be disposable following a single use.

One or more biological samples can be injected into respective sample injection ports and retained within respective sample reservoirs. Samples can be loaded while the diagnostic cartridge is mounted in the cartridge socket and engaged with the fluid management apparatus or can be loaded before being mounted in the diagnostic system. After one or more biological samples are delivered into the one or more sample reservoirs, the loaded diagnostic cartridge can be mounted into an electronic socket mounted within the receptacle of the diagnostic system. The same or different biological sample can be delivered to each of the sample reservoirs. A biological sample can comprise, for example, a biological fluid, a polynucleotide, or a protein.

The diagnostic cartridge can be positioned on the diagnostic cartridge socket. The cartridge can be aligned with the socket interconnects such as an array of spring-loaded interconnects by mechanical means such as using alignment pins or by optical means. When aligned, contact pads on the bottom of the diagnostic cartridge rest on respective spring-loaded micro-connectors. The alignment of the socket interconnects, the electrical contact pads on the lower surface of the diagnostic cartridge, the microvalves and ports on the upper surface of the diagnostic cartridge, and the fluid management apparatus can be done manually or robotically.

Mounting the diagnostic cartridge into the electronic socket electrically interconnects the diagnostic cartridge to the electronic interconnection substrate and to the electronics control and I/O circuitry. When mounted in the electronic socket, the fluid control valves on the top surface of the cartridge are positioned such that the fluid control valves are in-line with the valve control mechanism of the fluid management apparatus.

Following initialization, fluid management system can be lowered onto the diagnostic cartridge to engage the microvalves and the cartridge inlet port and the cartridge outlet port on the top surface of the diagnostic cartridge.

After the elements are aligned, the fluid management system can be further lowered onto the diagnostic cartridge to press the cartridge onto the spring-loaded micro-connectors.

The fluid management system is mounted on a self-leveling mount such that pressure is applied evenly to the diagnostic cartridge as the lower spring-loaded element is lowered onto the upper surface of the diagnostic cartridge. Mechanical microvalve activators such as solenoids engage with the septum of the microvalves, and couplings fluidly connect to the inlet and outlet ports.

At this point the diagnostic cartridge can be used for processing and biosensing a biological sample.

During disengagement, the diagnostic cartridge is held against the socket to allow the solenoids to disengage from the microvalves, after which the entire fluid management system can be raised.

Following retraction of the fluid management system, the diagnostic cartridge can be removed, and a new diagnostic cartridge can be inserted into the socket.

ASPECTS OF THE INVENTION

The invention is further defined by the following aspects.

Aspect 1. A diagnostic system, comprising: an interconnection substrate; a diagnostic cartridge socket electrically connected to the interconnection substrate; and a fluid management apparatus mounted on a translation stage, wherein the translation stage is configured to fluidly couple the fluid management apparatus to a diagnostic cartridge mounted in the diagnostic cartridge socket.

Aspect 2. The diagnostic system of aspect 1, wherein the interconnection substrate comprises a printed circuit board.

Aspect 3. The diagnostic system of any one of aspects 1 to 2, wherein the diagnostic cartridge socket comprises a temperature control element operationally coupled to a cartridge temperature sensor.

Aspect 4. The diagnostic system of aspect 3, wherein the temperature control element comprises a Peltier device.

Aspect 5. The diagnostic system of any one of aspects 1 to 4, wherein the diagnostic cartridge socket comprises an array of spring-loaded interconnects.

Aspect 6. The diagnostic system of any one of aspects 1 to 5, wherein the diagnostic cartridge socket comprises a diagnostic cartridge alignment mechanism.

Aspect 7. The diagnostic system of any one of aspects 1 to 6, wherein the fluid management apparatus comprises one or more microvalve actuators.

Aspect 8. The diagnostic system of aspect 7, wherein the one or more microvalve actuators is configured to operationally couple to one or more respective diagnostic cartridge microvalves.

Aspect 9. The diagnostic system of any one of aspects 7 to 8, wherein the one or more microvalve actuators comprise solenoids.

Aspect 10. The diagnostic system of any one of aspects 1 to 9, wherein the fluid management apparatus comprises one or more fluid couplings.

Aspect 11. The diagnostic system of aspect 10, wherein the one or more fluid couplings are configured to fluidly couple to one or more diagnostic cartridge inlet ports or to one or more diagnostic cartridge outlet ports.

Aspect 12. The diagnostic system of any one of aspects 1 to 11, wherein the fluid management apparatus comprises a self-leveling mount.

Aspect 13. The diagnostic system of any one of aspects 1 to 12, further comprising one or more pressure sources and one or more vacuum sources operationally coupled to the fluid management apparatus.

Aspect 14. The diagnostic system of aspect 13, wherein the one or more pressure sources comprise peristaltic pumps.

Aspect 15. The diagnostic system of any one of aspects 13 to 14, wherein the one or more vacuum sources comprise one or more peristaltic pumps.

Aspect 16. The diagnostic system of any one of aspects 1 to 15, wherein the translation stage comprises a stepper motor driven translation stage.

Aspect 17. The diagnostic system of any one of aspects 1 to 6, further comprising an alignment apparatus operationally coupled to the diagnostic cartridge socket, the fluid management apparatus, the translation stage, or a combination thereof configured to be operationally coupled to a diagnostic cartridge.

Aspect 18. The diagnostic system of any one of aspects 1 to 17, further comprising one or more reagent containers fluidly coupled to the fluid management apparatus.

Aspect 19. The diagnostic system of aspect 18, further comprising a valve coupled to each of the one or more reagent containers, wherein the valve is configured to selectively control the reagent or combination of reagents delivered to the fluid management apparatus.

Aspect 20. The diagnostic system of any one of aspects 1 to 19, further comprising a diagnostic cartridge mounted in the diagnostic cartridge socket.

Aspect 21. The diagnostic system of aspect 20, wherein the fluid management system is operationally coupled to the diagnostic cartridge.

Aspect 22. The diagnostic system of any one of aspects 1 to 21, wherein the diagnostic system comprises two or more diagnostic cartridges electrically connected to the interconnection substrate.

Aspect 23. The diagnostic system of any one of aspects 1 to 22, wherein the diagnostic system comprises two or more fluid management apparatus.

Aspect 24. The diagnostic system of any one of aspects 1 to 23, wherein the electronic interconnection substrate is mounted horizontally.

Aspect 25. The diagnostic system of any one of aspects 1 to 23, wherein the electronic interconnection substrate is mounted vertically.

Aspect 26. A diagnostic cartridge, comprising: a cartridge interconnection substrate; a biosensing device interconnected to the cartridge interconnection substrate; and a microfluidics component bonded to the cartridge interconnection substrate and fluidly coupled to the biosensing device.

Aspect 27. The diagnostic cartridge of aspect 26, wherein the cartridge interconnection substrate comprises a printed circuit board.

Aspect 28. The diagnostic cartridge of any one of aspects 26 to 27, wherein the biosensing device comprises from 1,000 to 10,000,000 biosensing cells.

Aspect 29. The diagnostic cartridge of any one of aspects 26 to 28, wherein each of the biosensing cells is configured to be electrically interconnected to a reference electrode, a working electrode, and a counter electrode.

Aspect 30. The diagnostic cartridge of any one of aspects 26 to 29, wherein the biosensing device comprises a biosensing device inlet and a biosensing device outlet.

Aspect 31. The diagnostic cartridge of any one of aspects 26 to 30, wherein the microfluidics component comprises: a first cartridge inlet port fluidly coupled to the biosensing device inlet through an inlet channel; a cartridge outlet port fluidly coupled to the biosensing device outlet through an outlet channel; and a second cartridge inlet port fluidly coupled to the outlet channel and to the biosensing device outlet channel through the second inlet channel.

Aspect 32. The diagnostic cartridge of aspect 31, further comprising: a microvalve disposed between the cartridge inlet port and the biosensing device inlet; and a microvalve disposed between the biosensing device outlet and the cartridge outlet port.

Aspect 33. The diagnostic cartridge of any one of aspects 31 to 32, further comprising: a bypass channel fluidly coupled to the inlet channel and to the outlet channel; and a microvalve disposed within the bypass channel.

Aspect 34. The diagnostic cartridge of any one of aspects 26 to 33, further comprising one or more sample inlet ports fluidly coupled to one or more respective sample reservoirs.

Aspect 35. The diagnostic cartridge of aspect 34, wherein each of the one or more sample inlet ports are disposed on a side of the diagnostic cartridge.

Aspect 36. The diagnostic cartridge of any one of aspects 34 to 35, wherein each of the one or more respective sample reservoirs is fluidly coupled to the biosensing device inlet.

Aspect 37. The diagnostic cartridge of any one of aspects 34 to 36, further comprising one or more sample microvalves disposed between the one or more respective sample reservoirs and the biosensing device inlet.

Aspect 38. The diagnostic cartridge of any one of aspects 26 to 37, further comprising four or more microvalves configured to control fluid flow within the microfluidic component and the biosensing device.

Aspect 39. The diagnostic cartridge of aspect 38, wherein each of the four or more microvalves is disposed on a top surface of the diagnostic cartridge.

Aspect 40. The diagnostic cartridge of any one of aspects 38 to 39, wherein each of the four or more microvalves is mechanically actuated microvalves.

Aspect 41. The diagnostic cartridge of any one of aspects 38 to 39, wherein each of the four or more microvalves is operationally coupled to a mechanical actuator.

Aspect 42. The diagnostic cartridge of any one of aspects 26 to 41, further comprising a temperature sensor disposed proximate to the biosensing device.

Aspect 43. The diagnostic cartridge of any one of aspects 26 to 42, wherein, the first cartridge inlet port is fluidly coupled to one or more reagent containers; the second cartridge inlet port is fluidly coupled to one or more reagent containers and/or to one or more pressure sources; and the cartridge outlet port is fluidly coupled to a waste container and/or to one or more vacuum sources.

It should be noted that there are alternative ways of implementing the embodiments disclosed herein. Accordingly, the present embodiments are to be considered as illustrative and not restrictive. Furthermore, the claims are not to be limited to the details given herein and are entitled their full scope and equivalents thereof.

What is claimed is:

1. A diagnostic system, comprising:

an interconnection substrate;

a diagnostic cartridge socket electrically connected to the interconnection substrate;

a fluid management apparatus mounted on a translation stage, wherein, the translation stage is configured to fluidly couple the fluid management apparatus to a diagnostic cartridge mounted in the diagnostic cartridge socket; and the translation stage is configured to fluidly coupled a vacuum source to a diagnostic cartridge mounted in the diagnostic cartridge socket.

2. The diagnostic system of claim 1, wherein the diagnostic cartridge socket comprises a diagnostic cartridge alignment mechanism.

3. The diagnostic system of claim 1, wherein the fluid management apparatus comprises one or more microvalve actuators.

4. The diagnostic system of claim 1, wherein the fluid management apparatus comprises one or more fluid couplings.

5. The diagnostic system of claim 4, wherein the one or more fluid couplings are configured to fluidly couple to one or more diagnostic cartridge inlet ports or to one or more diagnostic cartridge outlet ports.

6. The diagnostic system of claim 1, further comprising one or more pressure sources and one or more vacuum sources operationally coupled to the fluid management apparatus.

7. The diagnostic system of claim 1, further comprising a diagnostic cartridge mounted in the diagnostic cartridge socket.

8. The diagnostic system of claim 7, wherein the fluid management system is operationally coupled to the diagnostic cartridge.

9. A diagnostic cartridge, comprising:

a cartridge interconnection substrate;

a biosensing device interconnected to the cartridge interconnection substrate, wherein the biosensing device comprises:

a plurality of biosensing cells; and a biosensing device inlet and a biosensing device outlet; and a microfluidics component bonded to the cartridge interconnection substrate and fluidly coupled to the biosensing device;

a first cartridge inlet port fluidly coupled to the biosensing device through a cartridge inlet channel;

a cartridge outlet port fluidly configured to be coupled to the biosensing device through a cartridge outlet channel;

a second cartridge inlet port configured to be fluidly coupled to the cartridge outlet channel and to the cartridge inlet channel;

the second cartridge inlet port is configured to be fluidly coupled to one or more pressure sources; and the cartridge outlet port is configured to be fluidly coupled to one or more vacuum sources.

10. The diagnostic cartridge of claim 9, wherein each of the biosensing cells is configured to be electrically interconnected to a reference electrode, a working electrode, and a counter electrode.

11. The diagnostic cartridge of claim 9, further comprising one or more sample inlet ports fluidly coupled to one or more respective sample reservoirs.

12. The diagnostic cartridge of claim 11, further comprising one or more sample microvalves disposed between the one or more respective sample reservoirs and the biosensing device inlet.

13. The diagnostic cartridge of claim 9, further comprising four or more microvalves configured to control fluid flow within the microfluidic component and the biosensing device.

14. The diagnostic cartridge of claim 9, further comprising a temperature sensor disposed proximate to the biosensing device.

15. The diagnostic cartridge of claim 9, wherein, the first cartridge inlet port is fluidly coupled to one or more reagent containers;

the second cartridge inlet port is fluidly coupled to one or more reagent containers and/or to one or more pressure sources; and the cartridge outlet port is fluidly coupled to a waste container and to one or more vacuum sources.

* * * * *